United States Patent [19]

Suda et al.

[11] Patent Number: 4,822,532

[45] Date of Patent: Apr. 18, 1989

[54] CARBURETOR

[75] Inventors: Koichi Suda, Aichi; Fumio Sugi, Handa, both of Japan

[73] Assignee: Aisan Kogyo Kabushiki Kaisha, Obu, Japan

[21] Appl. No.: 133,379

[22] Filed: Dec. 15, 1987

Related U.S. Application Data

[63] Continuation of Ser. No. 714,042, Mar. 19, 1985, abandoned, which is a continuation of Ser. No. 509,233, Jun. 28, 1983, abandoned.

[30] Foreign Application Priority Data

Sep. 1, 1982 [JP] Japan ..... 57-151891

[51] Int. Cl.[4] ..... F02M 19/00

[52] U.S. Cl. ..... 261/65; 123/559.1; 137/312; 261/DIG. 51

[58] Field of Search ..... 123/559.1; 137/312; 261/65, DIG. 51

[56] References Cited

U.S. PATENT DOCUMENTS

| | | | |
|---|---|---|---|
| 2,139,841 | 12/1938 | Mennesson | 261/65 |
| 2,159,173 | 5/1939 | Mennesson | 261/65 |
| 2,766,768 | 10/1956 | Brown et al. | 137/312 |
| 3,411,526 | 11/1968 | Schaefer | 137/312 |
| 3,707,984 | 1/1973 | Bantz | 137/312 |
| 3,973,583 | 8/1976 | Sorenson | 137/312 |
| 4,334,011 | 11/1980 | Bake et al. | 137/312 |

FOREIGN PATENT DOCUMENTS

| | | | |
|---|---|---|---|
| 1245662 | 7/1967 | Fed. Rep. of Germany | 137/312 |
| 56-15281 | 11/1981 | Japan . | |

*Primary Examiner*—Tim Miles

*Attorney, Agent, or Firm*—Berman, Aisenberg & Platt

[57] ABSTRACT

A carburetor having a suction passage including therein a large venturi section and a throttle valve and connected at the upstream end thereof to the discharge port of a supercharger and at the downstream end thereof to the intake manifold of an internal combustion engine. A recess is formed either in the outer circumference of the shaft of the throttle valve or in the inside wall of a through hole formed in the body of a carburetor for pivotally supporting the shaft of the throttle valve, whereby a pressure chamber is formed between the shaft of the throttle valve and the through hole. The pressure chamber communicates with part of the suction passage upstream of the venturi tubes by a first air passage, and a second air passage opening into the through hole at a position between the suction passage and the pressure chamber communicates with the suction passage at a position downstream of the throttle valve. Pressure chambers which surround the throttle shaft are located to receive an air-fuel mixture when the pressure downstream of the venturi becomes greater than that upstream of the venturi and to feed the retained mixture into the carburetor when the pressure downstream of the venturi is lower than that upstream of the venturi.

2 Claims, 5 Drawing Sheets

CARBURETOR

This is a continuation of U.S. application Ser. No. 714,042, filed Mar. 19, 1985, now abandoned, which was a continuation of U.S. application Ser. No. 509,223, filed June 28, 1983, and now abandoned.

BACKGROUND OF THE INVENTION

1. Field of the Invention

The present invention relates to a carburetor to be used for an internal combustion engine equipped with a supercharger. In particular, a carburetor is designed to be connected at one end of a suction passage thereof to the discharge port of a supercharger and at the other end thereof to the intake manifold of an internal combustion engine. The carburetor has a main fuel nozzle opening into a venturi section formed in the suction passage to mix the air supplied from the supercharger with fuel according to the degree of opening of a throttle valve disposed downstream of the venturi section.

2. Description of the Prior Art

In a carburetor of an internal combustion engine equipped with no supercharger, an air current is formed in the suction passage thereof by a negative pressure produced in the intake manifold of the internal combustion engine. The negative pressure prevails in that part of the suction passage which is downstream of the throttle valve while the internal combustion engine is running. Accordingly, even if a throttle shaft fixed to the throttle valve is pivotally supported in and led outside of the body of the carburetor through a through hole formed in the body of the carburetor in order to connect the throttle shaft to the accelerator pedal through a linkage, there is no possibility of fuel leaking outside of the body of the carburetor through a clearance between the outer circumference of the throttle shaft and the inside wall of the through hole.

When a supercharger is provided upstream of the suction passage of the body of the carburetor in order to supercharge the internal combustion engine, the internal pressure of the intake manifold of the internal combustion engine sometimes becomes higher than the atmospheric pressure due to the operation of the supercharger. Consequently, there is a hazardous possibility of fuel, which is flowing within the suction passage of the carburetor and the intake manifold, being ejected and leaking together with air through the clearance in the throttle shaft supporting portion. In order to avoid such a hazardous possibility, it may be devised to form an air vent in the body of the carburetor so as to open at one end thereof into the suction passage at a position upstream of the venturi section and to open at the other end thereof into the through hole formed in the body of the carburetor for pivotally supporting the throttle shaft so that the supercharging pressure of the supercharger is applied to the clearance between the through hole and throttle shaft. However, even in such a construction, it is impossible to stop the ejected leak of fuel through the clearance thoroughly, because the pressure within the suction passage in the vicinity of the throttle valve fluctuates due to the pulsative variation of the internal pressure of the intake manifold of the internal combustion engine resulting from the cyclic operation of the internal combustion engine. In this constitution, the ejected leak of fuel can perfectly be stopped by the provision of a venturi section of a reduced diameter, however, reduction in the diameter of the venturi section impedes the flow of the suction air current through the suction passage of the carburetor causing the reduction of the output power of the internal combustion engine.

SUMMARY OF THE INVENTION

It is, therefore, one of the objects of the present invention to provide an improved carburetor to be used for an internal combustion engine equipped with a supercharger which can overcome the conventional drawbacks as mentioned above.

It is another object of the present invention to provide a carburetor to be used for an internal combustion engine equipped with a supercharger which ensures the prevention of fuel leakage through the clearance in the throttle shaft supporting portion by forming a pressure chamber in the throttle shaft supporting portion and introducing supercharging pressure prevailing in the suction passage of the carburetor upstream the venturi section into said pressure chamber.

According to the present invention, there is provided a carburetor, including a body, a suction passage formed in the body, a venturi section formed within the suction passage, a throttle valve disposed within the suction passage at a position downstream the venturi section and pivotally mounted by a throttle shaft at least one end thereof in a through hole formed in the body, at least one annular pressure chamber formed by a recess being cut either in the inside wall of the through hole or the outer circumference of the throttle shaft, a first passage opening at one end thereof into the suction passage at a position upstream the venturi section and at the other end thereof into the pressure chamber and a second passage opening at one end thereof into the suction passage at a position downstream of the throttle valve and at the other end thereof in the inside wall of the through hole at a position between the pressure chamber and the suction passage with respect to the axial direction of the throttle shaft, thereby an air current is formed from the suction passage upstream the venturi section to the suction passage downstream the throttle valve through the first passage, the pressure chamber, the clearance between the inside wall of the through hole and the outer circumference of the throttle shaft and the second passage by the agency of the pressure difference between the air pressure prevailing within the first passage and the air pressure prevailing within the second passage.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
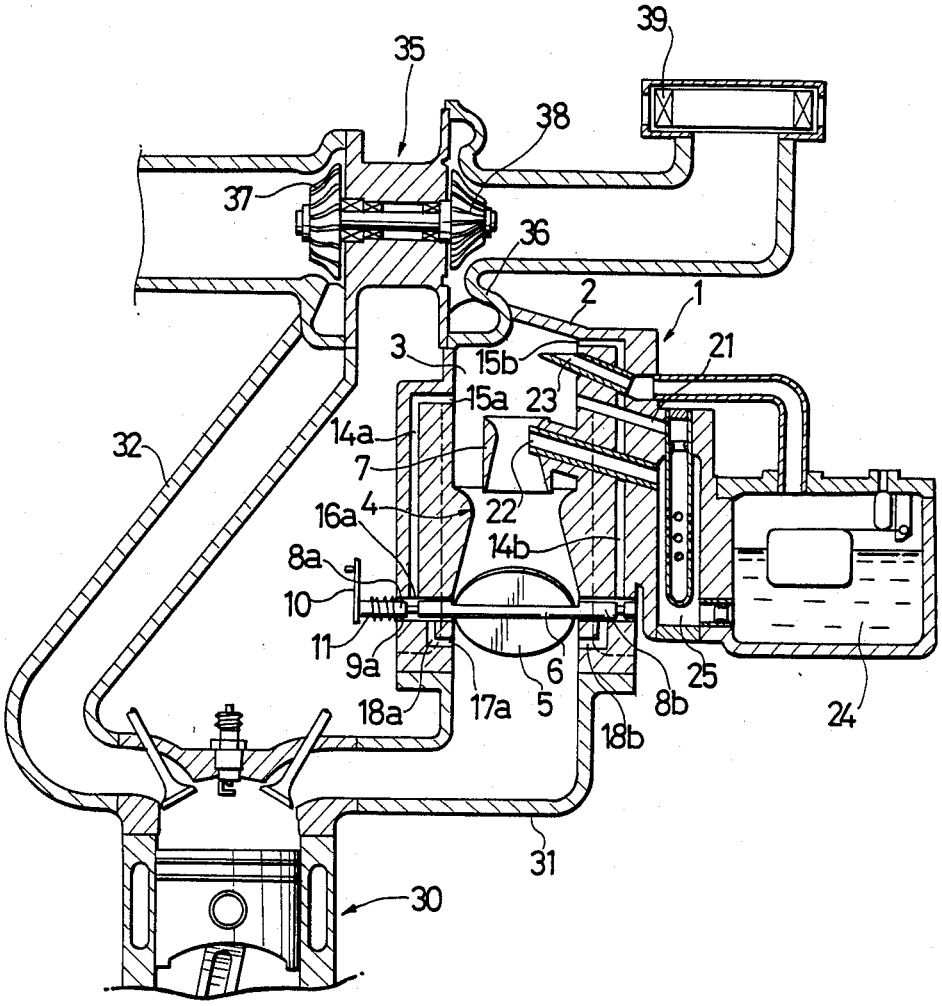
FIG. 1 is a sectional view of a first embodiment of the present invention.

Referring to FIG. 1 showing a first embodiment of the present invention, a carburetor 1 has, similar to known carburetors, a body 2, a suction passage 3 formed in the body 2, a venturi section 4 formed within the suction passage 3 and a throttle valve 5 disposed downstream of the venturi section 4 and pivotally mounted by a throttle shaft 6 on the body 2. At least one end portion 8*a* of the throttle shaft 6 is supported pivotally in and led outside of the body 2 through a through hole 9*a* formed in the body 2. A lever 10 connected to the accelerator pedal through a linkage, both are not shown, is connected to the throttle shaft 6 at the outside of the body 2. A torsion coil spring 11 is interposed between the lever 10 and the body 2 and urges the throttle valve 5 in a closing direction. A main fuel passage 25 communicates with a float chamber 24 included in the body 2, a main air bleed passage 21 and a main nozzle 22 projecting into a small venturi tube 7 disposed within the suction passage 3 in the venturi section 4. An air vent 23 projecting into the suction passage 3 at a position upstream of the venturi section 4 is connected to the upper space within the float chamber 24.

The body 2 of the carburetor 1 is joined to an internal combustion engine 30 with the downstream end of the suction passage 3 communicating with the intake manifold 31 of the internal combustion engine 30 and joined to the casing 36 of a supercharger 35 with the upstream end of the suction passage 3 communicating with the discharge port of the supercharger 35. The supercharger 35 employed in this embodiment is shown as a supercharger of the type having the casing 36 communicating with the exhaust passage 32 of the internal combustion engine 30, a turbine 37 disposed in the casing 36 is rotated by the agency of the exhaust gas and a pump impeller 38 is coaxially and fixedly connected to the turbine 37 so as to be rotated together with the turbine 37 to compress and then supply the air sucked in through an air filter 39 into the suction passage 3 of the carburetor 1.

Figure 2:
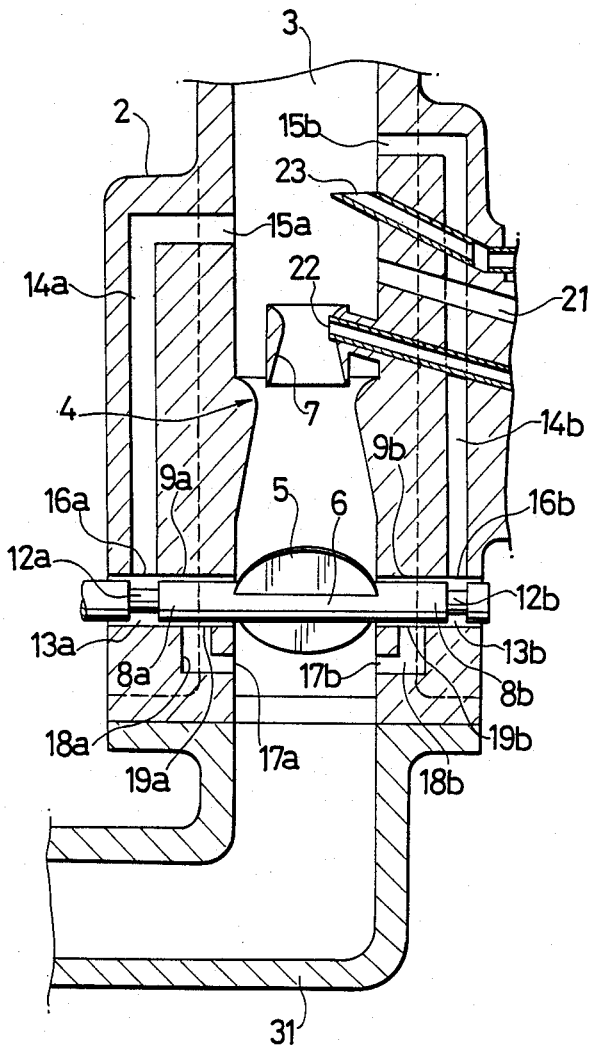
FIG. 2 is an enlarged diagrammatic sectional view of the essential part of FIG. 1, FIGS. 3 and 4 are enlarged diagrammatic sectional views of the modified constructions of the first embodiment, illustrating the relationship between the throttle shaft and the through hole.

In one end portion 8*a* of the throttle shaft 6 which is pivotally supported in the through hole 9*a* of the body 2 and connected to the lever 10, a recess 12*a* is formed by cutting part of the outer circumference of the throttle shaft 6 extending opposite the inside wall of the through hole 9*a* diametrically and concentrically with the throttle shaft 6 to form an annular pressure chamber 13*a* with the recess 12*a* and the inside wall of the through hole 9*a*. A first air passage 14*a* is drilled in the body 2 in parallel to the suction passage 3. One end of the first air passage 14*a* communicates with an air inlet 15*a* opening into the suction passage 3 at a position upstream the venturi section 4, while the other end thereof communicates with the pressure chamber 13*a* by an opening 16*a* formed in the inside wall of the through hole 9*a*. An enlarged view of the essential part of FIG. 1 is shown in FIG. 2.

A second air passage 18*a* communicating at one end thereof with the suction passage 3 by an opening 17*a* at a position downstream the throttle shaft 6 is drilled in the body 2. The other end of the second air passage 18*a* is opened in the inside wall of the through hole 9*a* by an opening 19*a* at a position between the suction passage 3 and the pressure chamber 13*a* somewhat apart axially of the throttle shaft 6 from the pressure chamber 13*a*.

When the hole for supporting an end portion 8*b* of the throttle shaft 6 opposite the end portion 8*a* connected to the lever 10 is a through hole 9*b* formed in the body 2, a recess 12*b* is cut in the end portion 8*b* similarly to the recess 12*a* to form a pressure chamber 13*b*. A first air passage 14*b* communicates with the suction passage 3 at a position upstream of the venturi section 4 by an inlet opening 15*b* at one end thereof and is connected to the pressure chamber 13*b* at the other end thereof. A second air passage 18*b* communicates with the through hole 9*b* by an opening 19*b* formed in the inside wall of the through hole 9*b* between the pressure chamber 13*b* and the suction passage 3 with respect to the axial direction of the throttle shaft 6 and communicates with the suction passage 3 by an opening 17*b* at a position downstream of the throttle shaft 6. In FIGS. 1 and 2, parts designated by reference numerals accompanied by a character "b" are equivalent to those designated by reference numerals accompanied by a character "a" but are on the opposite side of the suction chamber 3.

Figure 3:
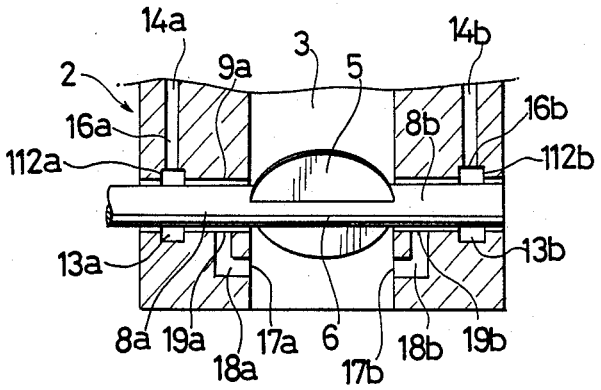
Figure 4:
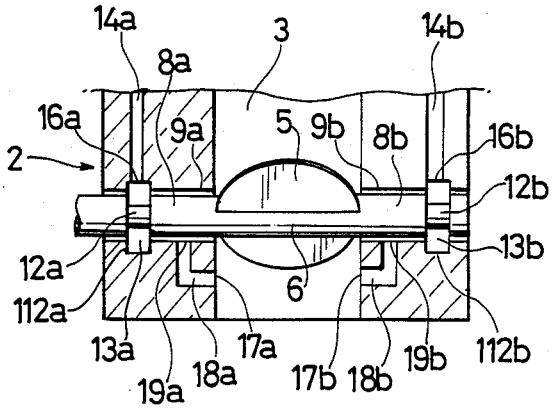

FIGS. 3 and 4 are enlarged diagrammatic sectional views of modified constructions of the first embodiment, each illustrating a manner of pivotally supporting the throttle shaft 6 in the body 2 of the carburetor 1. In the modified construction of FIG. 3, annular recesses 112*a* and 112*b* opening toward the outer circumference of the throttle shaft 6 are formed in the respective inside walls of the through holes 9*a* and 9*b* formed in the body 2 concentrically with the through holes 9*a* and 9*b* to provide the pressure chambers 13*a* and 13*b*. In the modified construction of FIG. 4, recesses 12*a* and 12*b*, which are the same with those shown in FIG. 2, are formed in the outer circumference of the throttle shaft and recesses 112*a* and 112*b*, which are the same with those of FIG. 3, are formed in the respective inside walls of the through holes 9*a* and 9*b* of the body 2 at positions corresponding to the recesses 12*a* and 12*b* with the respective openings of the recesses 112*a* and 112*b* facing the respective openings of the recesses 12*a* and 12*b*, respectively, to form pressure chambers 13*a* and 13*b*, respectively.

Figure 5:
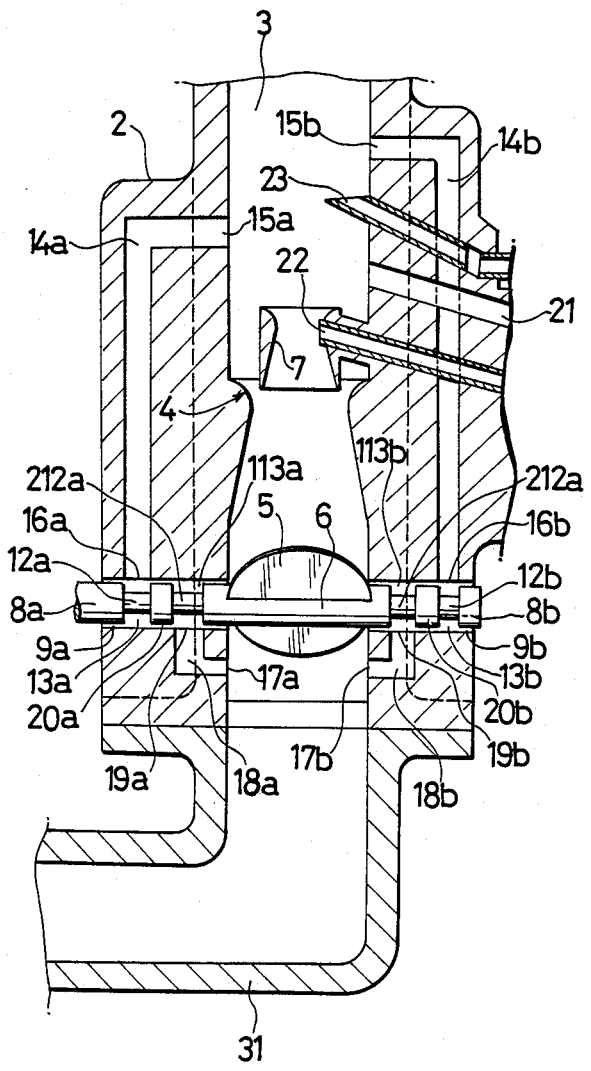
FIG. 5 is an enlarged sectional view of the essential part of a second embodiment of the present invention.

FIG. 5 is a sectional view of the essential part of a second embodiment of the present invention. The second embodiment is identical with the embodiment of FIGS. 1 and 2 except that annular second pressure chambers 113*a* and 113*b* are formed in addition to the first pressure chambers 13*a* and 13*b* formed in the end portions 8*a* and 8*b*, respectively, of the throttle shaft 6 as in the first embodiment of FIGS. 1 and 2. Chambers 113*a* and 113*b* are located at positions nearer to the suction passage 3, axially of the throttle shaft 6 than are the recesses 12*a* and 12*b*. The second air passages 18*a* and 18*b* communicate with the second pressure chambers 113*a* and 113*b* by openings 116*a* and 116*b*, respectively. Recesses 212*a* and 212*b* are formed by cutting throttle shaft 6 radially and concentrically with the throttle shaft 6. The inside walls of the through holes 9*a* and 9*b* and the recesses 212*a* and 212*b*, respectively, form the second pressure chambers 113*a* and 113*b*, and lands 20*a* and 20*b* are formed between the first pressure chambers 13*a* and 13*b* and the second pressure chambers 113*a* and 113*b*.

Figure 6:
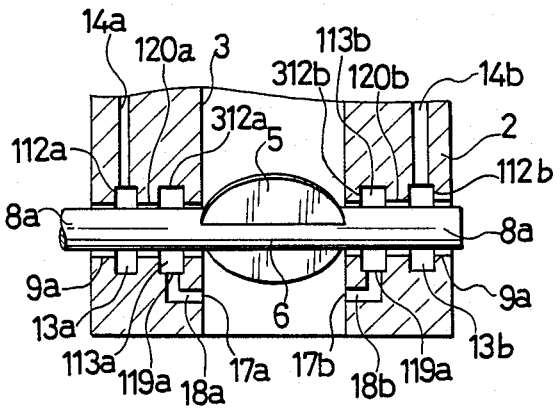
FIGS. 6 and 7 are enlarged diagrammatic sectional views of the modified constructions of the second embodiment, illustrating the relationship between the throttle shaft and the through hole.
Figure 7:
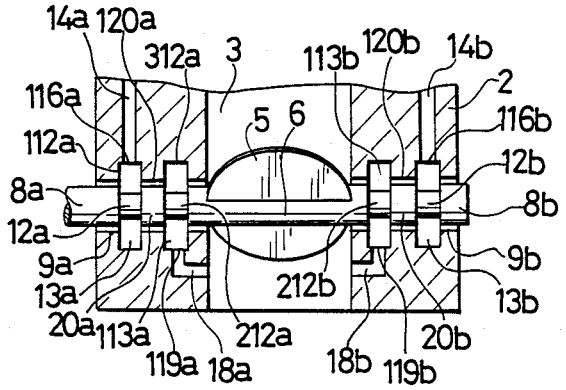

FIGS. 6 and 7 are enlarged diagrammatic sectional views of modified constructions of the second embodiment, each illustrating a manner of pivotally supporting the throttle shaft 6 in the body 2 of the carburetor 1. Whereas the recesses 12*a*, 12*b*, 212*a* and 212*b* are formed in the outer circumference of the throttle shaft 6 in the embodiment shown in FIG. 5, in the modified construction of FIG. 6, annular recesses 112*a*, 112*b*, 312*a* and 312*b* are formed in the inside walls of the through holes 9*a* and 9*b* formed in the body 2 concentrically with the through holes 9*a* and 9*b*, respectively, similarly to those shown in FIG. 3 so as to open toward the outer circumference of the throttle shaft 6 to form pressure chambers 13*a*, 13*b*, 113*a* and 113*b*. In this modification, lands 120*a* and 120*b* are formed in the inside wall of the through holes 9*a* and 9*b* of the body 2 between the first pressure chambers 13*a* and 13*b* and the second pressure chambers 113*a* and 113*b* respectively. In the modification of FIG. 7, recesses 12*a*, 12*b*, 212*a* and 212*b*, which are similar to those shown in FIG. 5, are formed in the respective outer circumferences of the end portions 8*a* and 8*b* of the throttle shaft 6, while recesses 112*a*, 112*b*, 312*a* and 312*b*, which are similar to those shown in FIG. 6, are formed in the respective inside walls of the through holes 9*a* and 9*b* formed in the body 2 to form first pressure chambers 13*a* and 13*b* and second pressure chambers 113*a* and 113*b*, respectively. The lands 20*a* and 20*b* of the throttle shaft 6 are located opposite to the lands 120*a* and 120*b* of the through holes 9*a* and 9*b* formed in the body 2, respectively.

When the supercharger 35 is operated, the pump impeller 38, which is rotated together with the turbine 37, compresses the air sucked in through the air filter 39 and supplies the compressed air to the suction passage 3 of the carburetor 1. The air of a supercharging pressure of the supercharger 35 supplied into the suction passage 3, flows into the float chamber 24 through the air vent 23 as well as into the main fuel passage 25 through the main air bleeding passage 21. The fuel mixed with air in the main fuel passage 25 is caused to flow into the suction passage 3 through the main nozzle 22 by the agency of the pressure difference between the static pressure of the air current flowing through the suction passage at the venturi section 4, particularly at the small venturi tube 7, at a rate corresponding to the degree of opening of the throttle valve 5 and the static pressure prevailing within the float chamber 24 and the fuel is atomized and supplied together with air into the intake manifold 31 of the internal combustion engine 30. The air containing the atomized fuel will be referred to as "air-fuel mixture" hereinafter.

As the supercharging pressure rises with the operation of the supercharger 35, the internal pressure of the suction passage 3 and the intake manifold 31 of the internal combustion engine 30 sometimes exceeds the atmospheric pressure. However, there is no possibility of the air-fuel mixture blowing and leaking through the clearances formed between the respective inside walls of the through holes 9*a* and 9*b* and the outer circumference of the end portions 8*a* and 8*b* of the throttle shaft 6. The first pressure chambers 13*a* and 13*b* are formed in clearances between the end portions 8*a* and 8*b* of the throttle shaft 6 and the through holes 9*a* and 9*b* by the recesses 12*a* and 12*b* or by the recesses 112*a* and 112*b*. Air having a supercharging pressure prevailing within the suction passage 3 at the position upstream the venturi section 4 is applied to the pressure chambers 13*a* and 13*b* through the first air passages 14*a* and 14*b* and the openings 15*a* and 15*b*, respectively, while the clearances formed between the end portions 8*a* and 8*b* and the through holes 9*a* and 9*b* nearer to the suction passage 3 with respect to the pressure chambers 13*a* and 13*b* are connected to the suction passage 3 through the second passages 18*a* and 18*b* at the openings 17*a* and 17*b* opening in the suction passage 3 downstream of the throttle valve 5. In this state, suppose that the static pressure prevailing within the first air passages 14*a* and 14*b* is $P_1$, the static pressure prevailing in the vicinity of the openings of the through holes 9*a* and 9*b* facing the suction passage 3 is $P_2$ and the static pressure prevailing within the second air passages 18*a* and 18*b* is $P_3$. Then, the static pressure $P_1$ is as great as the air pressure prevailing in the vicinity of the openings 15*a* and 15*b* of the first air passages 14*a* and 14*b* opening into the suction passage 3, namely, the supercharging pressure, the static pressure $P_2$ is smaller than the static pressure $P_1$ by a pressure drop attributable to the presence of the venturi section 4 and the small venturi tube 7 in the suction passage 3, and the static pressure $P_3$ is lower than the static pressure $P_2$ naturally when the suction passage 3 is choked by the throttle valve 5 and even when the throttle valve 5 is fully opened due to the effect of the presence of the throttle valve 5 and the throttle shaft 6 in the suction passage 3. Accordingly, the relation between the static pressure $P_1$, $P_2$ and $P_3$ are indicated by an inequality:

$$P_1 > P_2 > P_3$$

Accordingly, air currents flowing from the first air passages 14*a* and 14*b* into the section of the suction passage 3 downstream the throttle valve 5 via the second air passages 18*a* and 18*b* around the end portions 8*a* and 8*b* of the throttle shaft 6 is formed in the normal condition. Consequently, there is no possibility of the air-fuel mixture being ejected and leaking through the clearances formed between the inside wall of the through holes 9*a* and 9*b* of the body 2 and the outer circumference of the end portions 8*a* and 8*b* of the throttle shaft 6, during the steady-state operation of the internal combustion engine.

When the pulsative variation of pressure according to the operating cycle of the internal combustion engine occurs within the intake manifold 31 due to the operating condition of the internal combustion engine 30, sometimes a flow of the air-fuel mixture from the suction passage 3 to the outside of the body 2 along the outer circumference of the throttle shaft 6 occurs when the pulsative pressure rises near the peak of the pulsation. In such a case, the air flowing through the first air passages 14*a* and 14*b* into the pressure chambers 13*a* and 13*b* is discharged outside of the body 2, whereas the air-fuel mixture which flows from the suction passage 3 into the clearances between the inside wall of the through holes 9*a* and 9*b* and outer circumference of the end portions 8*a* and 8*b* is kept in the pressure chambers 13*a* and 13*b*, so that the air-fuel mixture is not allowed to leak outside of the body 2. The air-fuel mixture kept in the pressure chambers 13*a* and 13*b* is returned to the suction passage 3 by air currents flowing from the first air passages 14*a* and 14*b* into the second air passages 18*a* and 18*b* when the pulsative pressure drops near the bottom point of the pulsation and then fresh air flows through the first air passages 14*a* and 14*b* into and fills the pressure chambers 13*a* and 13*b*. The repetition of such air flow prevents the fuel leakage outside of the carburetor.

Furthermore, when the second pressure chambers 113a and 113b are formed nearer to the suction passage 3 axially of the throttle shaft 6 with respect to the first pressure chambers 13a and 13b, one end of the second air passage 18a and one end of the second air passage 18b are opened into the second pressure chambers 113a and 113b, respectively, at positions 119a and 119b, respectively. Lands 20a and 120a and lands 20b and 120b are formed between the first pressure chamber 13a and the second pressure chamber 113a and between the first pressure chamber 13b and the second pressure chamber 113b respectively, and air currents develop which flow from the first air passages 14a and 14b into the suction passage 3 through the first pressure chambers 13a and 13b, the second pressure chambers 113a and 113b, and the second air passages 18a and 18b. Accordingly, when the pulsative variation of pressure occurs in the intake manifold 31, the air supplied through the first air passages 14a and 14b to the first pressure chambers 13a and 13b and then to the second pressure chambers 113a and 113b is caused to leak outside of the body 2, whereas the air-fuel mixture which flows from the suction passage 3 into the clearance between the outer circumference of the end portions 8a and 8b of the throttle shaft 6 and the inside walls of the through holes 9a and 9b is kept in the first pressure chambers 13a and 13b and in the second pressure chambers 113a and 113b. Thus, increase in the capacity of the pressure chamber brought about by the provision of two pressure chambers in each through hole produces greater advantage or effect for preventing fuel leakage as compared with the construction using only the first pressure chambers.

As described in detail hereinbefore, in a carburetor having a suction passage formed in a body and designed to be connected at one end thereof to the discharge port of a supercharger and at the other end thereof to the intake port of an internal combustion engine, a venturi section formed in the suction passage, a main fuel nozzle opening into the venturi section and a throttle valve disposed in the suction passage downstream of the venturi section and held by a throttle shaft pivotally supported at least at one end thereof in a through hole formed in the body, the present invention is characterized in that at least one annular pressure chamber is formed by at least one recess formed either in the inside wall of the through hole formed in the body or in the outer circumference of the throttle shaft by cutting the same inside wall or the same outer circumference perpendicularly to the axial direction of the throttle shaft to open toward the surface of the opposite part. A first air passage is formed to open at one end thereof into the suction passage at a position upstream of the venturi section and at the other end thereof into the pressure chamber, and a second air passage is formed to open at one end thereof into the suction passage at a position downstream of the throttle valve and at the other end thereof in the inside wall of the through hole at a position between the pressure chamber and the suction passage with respect to the axial direction of the throttle shaft. Accordingly, the supercharging air pressure produced by the supercharger and prevailing in the part of the suction passage upstream of the venturi section is applied to the pressure chamber, while the air pressure prevailing in the part of the suction passage which is downstream the throttle valve of the carburetor is applied to the clearance between the part of the inside wall of the through hole extending from the pressure chamber toward the suction passage and the outer circumference of the throttle shaft. Consequently, an air current flows from the first air passage toward the second air passage via the clearance during the steady-state operation of the internal combustion engine even when the supercharging air pressure exceeds the atmospheric pressure, to eliminate the danger of the fuel supplied into the suction passage being ejected and leaking outside of the body together with air through the clearance. Furthermore, even when the pulsative variation of pressure according to the operating cycle of the internal combustion engine occurs within the intake manifold in a particular operating state of the internal combustion engine and the airstate fuel mixture flowing through the suction passage is caused to flow into the clearance by a high pressure near the peak of the pulsating pressure, the air supplied through the first air passage and occupying the pressure chamber is discharged outside of the body, whereas the air-fuel mixture which flows into the pressure chamber through the clearance is kept in the pressure chamber and when the pulsating pressure drops near the lowest pressure, the air-fuel mixture which has been kept in the pressure chamber is returned to the suction passage by the agency of an air current flowing from the first air passage into the second air passage and at the same time, the pressure chamber is filled with fresh air supplied through the first air passage. Thus the leakage of the fuel to the outside of the body of a carburetor, which is a serious problem in a carburetor to be used for an internal combustion engine equipped with a supercharger, is prevented and the effective use of fuel is attained.

Still further, according to the present invention, a second pressure chamber is formed similarly to the said first pressure chamber at a position nearer to the suction passage than that of the first pressure chamber with respect to the axial direction of the throttle shaft with a small interval between the first and the second pressure chambers. The second air passage is opened at one end thereof into the second pressure chamber so that the air pressure prevailing within the first pressure chamber and the air pressure prevailing within the second pressure chamber interact and an air current flowing from the first pressure chamber toward the second pressure chamber is produced in the clearance extending between the first and the second pressure chambers in the normal condition. When a current of the air-fuel mixture, which tends to flow from the suction passage of the carburetor to the outside of the body along the outer circumference of the throttle shaft, is produced due to the pulsative variation of the pressure according to the operating cycle of the internal combustion engine within the intake manifold, the air supplied from the first pressure chambers into and the second pressure chambers through the first air passage is discharged outside of the body, and the airfuel mixture is kept in the first and the second pressure chambers to prevent the air-fuel mixture from leaking outside of the body of the carburetor. The axial series arrangement of two pressure chambers in the throttle shaft supporting portion enhances further the effect of preventing fuel leakage outside of the carburetor. When the pulsating pressure drops to a pressure near the lower pressure of the pulsation, the air-fuel mixture which has been kept in the first and the second pressure chambers is sucked, as described hereinbefore, into the suction passage of the carburetor by the agency of an air current flowing from the first air passage to the second air passage and naturally, the mixture thus returned into the suction passage is consumed by the internal combustion engine.

We claim

1. In a carburetor including a body, a suction passage formed in said body and designed to be connected at one end thereof to a discharge port of a supercharger and at the other end thereof to an intake port of an internal combustion engine, a venturi section formed within said suction passage, a main fuel nozzle opening into the venturi section and a trottle valve disposed within the suction passage at a position downstream of the venturi section and held by a throttle shaft which is supported pivotally at least at one end thereof in a through hole formed in said body, said carburetor comprising;

means to support said throttle shaft and to prevent leakage of air-fuel mixture, said means to support and prevent consisting of said through hole and at least two pressure chambers for receiving any air-fuel mixture passing outwardly along said through hole away from said suction passage and for retaining said air-fuel mixture during a pulsative variation in pressure occurring during the operating cycle of said engine, said pressure chambers surrounding said trottle shaft on one side of said throttle valve and located between said throttle shaft and a wall of said through hole, a first passage extending between a first of said pressure chambers and a first location in said suction passage upstream of said venturi for applying a pressure at said first location to said first pressure chamber and a second passage extending between a second location in said suction passage downstream of said throttle valve and a second of said pressure chambers between said first pressure chamber and said suction passage for applying a pressure at said second location to said second of said pressure chambers, said first pressure chamber being arranged remotely from said suction passage axially along said throttle shaft, said second pressure chamber being arranged between said first pressure chamber and said suction passage axially along said throttle shaft, said first and second pressure chambers being formed in the inside walls of said through holes and opening toward a respective cylindrical outer wall of said throttle shaft, the width of each of said first and second pressure chambers along said throttle shaft being greater than the width of a respective one of said first and second passages along said throttle shaft.

2. The carburetor of claim 1 wherein at least one of said pressure chambers further comprises an annular recess in said throttle shaft.

* * * * *